US010988830B2

(12) United States Patent
Ricketts

(10) Patent No.: US 10,988,830 B2
(45) Date of Patent: Apr. 27, 2021

(54) SCANDIUM MASTER ALLOY PRODUCTION

(71) Applicant: Scandium International Mining Corporation, Sparks, NV (US)

(72) Inventor: Nigel Ricketts, Mount Crosby (AU)

(73) Assignee: Scandium International Mining Corporation, Sparks, NV (US)

( * ) Notice: Subject to any disclaimer, the term of this patent is extended or adjusted under 35 U.S.C. 154(b) by 317 days.

(21) Appl. No.: 16/249,873

(22) Filed: Jan. 16, 2019

(65) Prior Publication Data

US 2019/0218644 A1 Jul. 18, 2019

Related U.S. Application Data

(60) Provisional application No. 62/618,069, filed on Jan. 16, 2018.

(51) Int. Cl.
*C22C 1/02* (2006.01)
*C22C 21/00* (2006.01)

(52) U.S. Cl.
CPC ..... *C22C 1/026* (2013.01); *C22C 21/00* (2013.01)

(58) Field of Classification Search
CPC ..... C22C 21/00; C22C 1/026
See application file for complete search history.

(56) References Cited

U.S. PATENT DOCUMENTS

| | | | |
|---|---|---|---|
| 3,619,181 | A | 11/1971 | Willey |
| 4,689,090 | A | 8/1987 | Sawtell et al. |
| 5,037,608 | A | 8/1991 | Tarcy et al. |
| 5,238,646 | A | 8/1993 | Tarcy et al. |
| 5,597,529 | A | 1/1997 | Tack |
| 6,711,819 | B2 | 3/2004 | Stall et al. |
| 2011/0070120 | A1 | 3/2011 | Kim et al. |

FOREIGN PATENT DOCUMENTS

| | | | |
|---|---|---|---|
| AU | 201572 | A1 | 10/2014 |
| CN | 1184356 | C | 1/2005 |
| CN | 100410400 | C | 8/2008 |
| CN | 100417930 | C | 9/2008 |
| CN | 101941122 | B | 8/2012 |
| CN | 102220502 | B | 11/2012 |
| CN | 102653829 | B | 11/2013 |
| CN | 105886850 | A | 8/2016 |
| CN | 106987735 | A | 7/2017 |
| CN | 107868888 | A | 4/2018 |
| CN | 107974597 | A | 5/2018 |
| EP | 2298944 | B1 | 7/2013 |
| JP | 4224532 | B2 | 2/2009 |
| RU | 2211872 | C1 | 9/2003 |
| RU | 2213795 | C1 | 10/2003 |
| RU | 2002106416 | A | 10/2003 |
| RU | 2361941 | C2 | 7/2009 |
| RU | 2426807 | C2 | 3/2011 |
| RU | 2421537 | C2 | 6/2011 |
| RU | 2507291 | C1 | 2/2014 |
| RU | 2587700 | C1 | 6/2016 |
| RU | 2593246 | C1 | 8/2016 |
| SU | 1348122 | A1 | 10/1987 |
| SU | 1580826 | A1 | 6/1999 |
| WO | 2006079353 | A1 | 8/2006 |

OTHER PUBLICATIONS

Hua Xie,Jie Wang, Zhengbo Qin, Lei Shi, Zichao Tang, and Xiaopeng Xing, 'Octacoordinate Metal Carbonyls of Lanthanum and Cerium: Experimental Observation and Theoretical Calculation', J. Phys. Chem. A (2014), 118, 9380-9385.

P. C. Feijoo, A. del Prado, M. Toledano-Luque, E. San Andrés, and M. L. Lucía, "Scandium oxide deposited by high-pressure sputtering for memory devices: Physical and interfacial properties", Journal of Applied Physics 107, 084505 (2010).

Skachkov, Vladimir & Varchenya, P.A. & Ovsyannikov, Boris & Yatsenko, S.P. (2013), "Injection of scandium-containing process powders into aluminum alloys", Tsvetnye Metally. 81-86. (English Abstract).

"Synthesis and Properties of Aluminum Master-Alloy With Scandium, Zirconium and Hafnium".

B. P. Kulikov, V. N. Baranov, A. I. Bezrukikh, V. B. Deev, and M. M. Motkov, "Preparation of Aluminum-Scandium Master Alloys by Aluminothermal Reduction of Scandium Fluoride Extracted from Sc2O3", Metallurgist, vol. 61, Nos. 11-12, Mar. 2018 (Russian Original Nos. 11-12, Nov.-Dec. 2017).

Yuriy Shtefanyuk, Victor Mann, Vitaliy Pingin, Dmitriy Vinogradov, Yuriy Zaikov, Olga Tkacheva, Andrey Nikolaev, Andrey Suzdaltsev, "Production of Al—Sc Alloy by Electrolysis of Cryolite-Scandium Oxide Melts", TMS (The Minerals, Metals & Materials Society) (Mar. 2015).

(Continued)

*Primary Examiner* — Jessee R Roe

(74) *Attorney, Agent, or Firm* — John A. Fortkort; Fortkort & Houston PC

(57) ABSTRACT

A method is provided for forming a scandium-bearing aluminum alloy. The method includes preparing a mixture of scandium oxide and a first flux, thereby obtaining a flux-oxide mixture; mixing the flux-oxide mixture with a first portion of molten metal selected from the group consisting of aluminum and aluminum alloys, thereby obtaining a flux-metal mixture; obtaining a scandium-containing master alloy from the flux-metal mixture by performing the steps, in any order, of (a) cooling the flux-metal mixture, and (b) separating at least a portion of the flux from the flux-metal mixture; adding the scandium-bearing master alloy to a second portion of molten metal selected from the group consisting of aluminum and aluminum alloys, thereby obtaining a second metal mixture; and cooling the second metal mixture to obtain a scandium-bearing aluminum alloy; wherein the first flux contains less than 20% fluoride by weight, based on the total weight of flux added to the molten metal.

24 Claims, 1 Drawing Sheet

(56) References Cited

OTHER PUBLICATIONS

Hidenori Fujii, Hiroomi Akiyama1, Junichi Kaneko, Makoto Sugamata and Ludwik Blaz, "Al—Sc Master Alloy Prepared by Mechanical Alloying of Aluminum with Addition of Sc2O3", Materials Transactions, vol. 44, No. 5 (2003) pp. 1049 to 1052.

V. M.Skachkov, L.A.Pasechnik, S.P.Yatsenko, "Introduction of Scandium, Zirconium and Hafnium Into Aluminum A Lloys, Dispersion Hardening Ofi Ntermetallic Compounds With Nanodimensional Particles", Nanosystems: Physics, Chemistry, Mathematics (2014), 5(4),p. 603 {612).

A. H. Ratner, M. B. Geilikman, S. V. Aleksandrovski, "Thermodynamic calculation on metallic thermoreduction during preparation of aluminum rare master alloys", Trans. Nonferrous Met. Soc. China (Feb. 2001), vol. 11, No. 1.

O. Yu. Tkachevaa, I. G. Brodovab, P. A. Arhipova, and Yu. P. Zaikov, "Influence of Crystallization Conditions on the Structure and Modifying Ability of Al—Sc Alloys", Russian Journal of Non-Ferrous Metals (2017), vol. 58, No. 1, pp. 67-74.

Masanori Harata, Takao Nakamura, Hiromasa Yakushiji, Toru H. Okabe, "Production of Scandium and Al—Sc Alloy by Metallothermic Reduction", Journal Mineral Processing and Extractive Metallurgy Transactions of the Institutions of Mining and Metallurgy: Section C vol. 117 (2008)—Issue 2.

A. Varchenya, P & Ovsyannikov, Boris & P. Yatsenko, S & Sabirzyanov, N & Pasechnik, Liliya, "Synthesis and Properties of Aluminum Master-Alloy With Scandium, Zirconium and Hafnium", First International Congress, Non-Ferrous Metals of Siberia, Part 3—Non-Ferous and Rare Metals Production (2009).

Skachkov, Vladimir & Yatsenko, S.P. "Obtaining of Sc, Zr, Hf and Y base metals on the basis of aluminum by method of high-temperature exchange reactions in salt melts", (2014) 22-26. (English Summary).

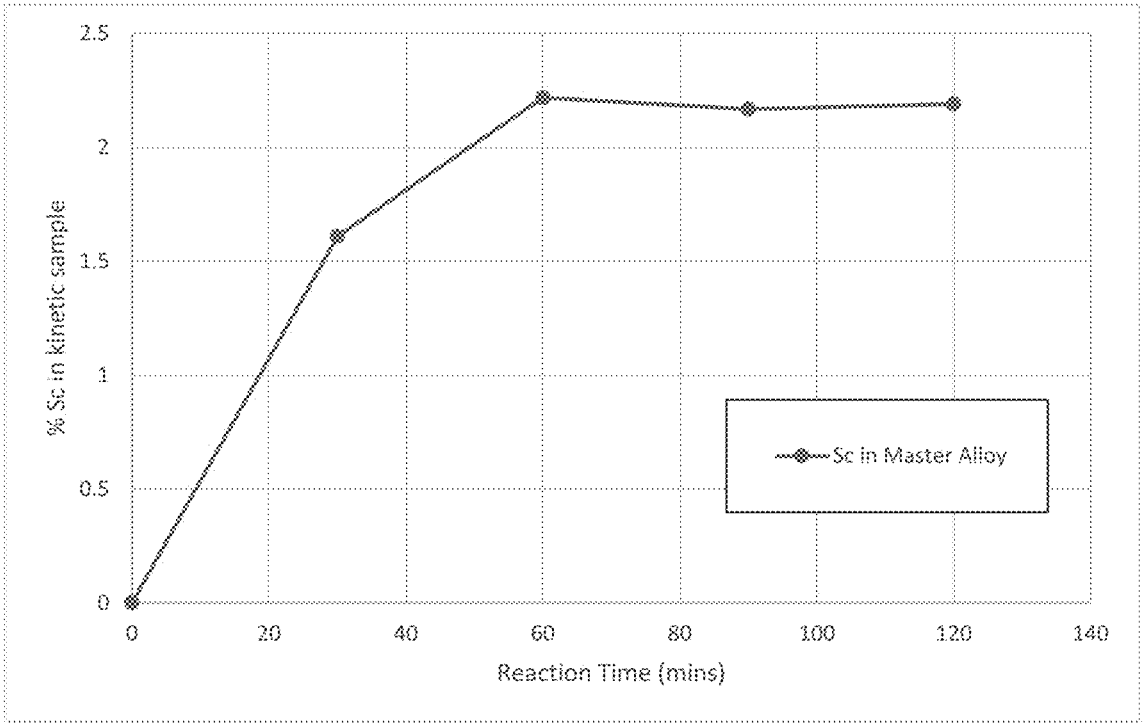
2.5
2
1.5
1
0.5
0
% Sc in kinetic sample
0
20
40
60
80
100
120
140
Reaction Time (mins)
Sc in Master Alloy

SCANDIUM MASTER ALLOY PRODUCTION

CROSS-REFERENCE TO RELATED APPLICATION

This application claims the benefit of priority from U.S. provisional application No. 62/618,069, filed Jan. 16, 2018, having the same inventor, and the same title, and which is incorporated herein by reference in its entirety.

FIELD OF THE DISCLOSURE

The present disclosure relates generally to systems and methodologies for forming scandium alloys, and more particularly to systems and methodologies for forming scandium-containing master alloys.

BACKGROUND OF THE DISCLOSURE

Recently, several advances have been made in the synthesis of scandium-aluminum alloys. These include, for example, those described in WO2016/130426 (Duyvesteyn), entitled "SCANDIUM-CONTAINING MASTER ALLOYS AND METHODS FOR MAKING THE SAME". In an embodiment of the methodology described therein, a scandium-containing precursor is mixed with a molten metal containing aluminum. The precursor undergoes thermal decomposition to produce scandium oxide, which reacts with the aluminum to produce a scandium-aluminum alloy.

Scandium oxide is the most traded form of scandium. This is due to the fact that scandium recovery processes commonly utilize scandium oxalate precipitation (due to its high selectivity over a number of possible impurity elements), and the fact that the resulting scandium oxalate (commonly in the form of the pentahydrate salt) is typically calcined to produce scandium oxide.

The addition of scandium oxide to aluminum alloys to produce scandium-containing aluminum alloys is not thermodynamically favorable. Nonetheless, it can proceed via the reaction below due to the typically low activity of scandium in molten aluminum alloys:

$$Sc_2O_3+2Al \rightarrow 2Sc_{[Al]}+Al_2O_3$$

The addition of scandium to aluminum alloys is most commonly implemented through the addition of a 2% Sc—Al master alloy to the molten metal. In order to produce such a master alloy from scandium oxide, approximately 4% by weight of scandium oxide of the aluminum content of the alloy is required. This produces a similar amount of aluminum oxide as a by-product. Such a large amount of aluminum oxide by-product is detrimental to the physical quality of the scandium-aluminum master alloy and the aluminum alloys it is subsequently added to.

In order to remove aluminum oxide from aluminum alloys, most aluminum processing operations either add in a low-melting point flux (which is usually a combination of alkali metal halides), inject inert gases into the melt, or do both. The oxides preferentially wet the flux rather than the metal, and hence, the subsequent physical separation of the flux and metal removes the oxide from the alloy.

The 4% aluminum oxide by-product attendant to the formation of the master alloy is well above the levels of aluminum oxide that are normally dealt with in aluminum processing operations. Consequently, the choice of flux is critical. Moreover, a substantial mass of flux (around 10% of the mass of the aluminum) will typically be required. Unfortunately, when scandium oxide is added to aluminum alloys in the presence of such a flux, a portion of the scandium oxide may also get caught up in the flux, thus preventing it from reacting with the aluminum alloy. This problem is exacerbated as the amount of flux increases.

One known method for adding scandium to aluminum alloys is to first convert the scandium oxide to scandium fluoride, which reacts with molten aluminum more easily than does scandium oxide. This is typically accomplished by reacting the scandium oxide with hot hydrogen fluoride gas at high temperatures. This approach is both dangerous and technically difficult, given the high toxicity and reactivity of hydrogen fluoride gas.

EP2298944 B1 (Kwang et al.), entitled "Method of Manufacturing A Magnesium-Scandium Master Alloy and Method Of Making An Aluminium Alloy Containing Scandium", discloses a method of adding scandium oxide into aluminium alloys by first reacting the scandium oxide with molten magnesium or a molten magnesium-aluminium alloy. The reference suggests that metallothermic reduction of scandium oxide by metallic magnesium is preferable to aluminium. This finding would appear to be supported by Ratner et al., "Thermodynamic Calculation of Metallic Thermoreduction During Preparation of Aluminium-Rare Master Alloys", Trans Nonferrous Met Soc China, 11 (1) February 2001:18-21. Ratner et al. examined the thermodynamics and equilibrium conditions for aluminothermic reduction of scandium oxide, scandium chloride and scandium fluoride. They concluded that magnesium was the best reduction agent for metallothermic reduction of scandium compounds.

Varchenya, P. A. et al., "Synthesis and Properties of Aluminum Master-Alloy with Scandium, Zirconium and Hafnium", First International Congress, Non-Ferrous Metals of Serbia (2009), Part III, 421-424, examined the use of both scandium fluoride and scandium oxide for production of Al—Sc master alloys, achieving 96% recovery with scandium fluoride and only 80% recovery with scandium oxide. The flux mixtures comprised mostly potassium chloride and sodium fluoride, although aluminium fluoride was added ion some tests. The addition of aluminium fluoride was said to enhance the coalescence of aluminium metal droplets. Stirring (described as "intensive") for 15-20 minutes was utilized during addition.

A number of attempts have been made to produce Al—Sc master alloys via electrolysis of molten salts, using molten aluminium as the cathode. For example, Shtefanyuk et al., "Production of Al—Sc Alloy By Electrolysis Of Cryolite-Scandium Oxide Melts", Light Metals, The Minerals, Metals & Materials Society, pp 589-593 (2015), describes the use of a standard aluminium electrolysis cell to which scandium oxide was added to the sodium cryolite electrolyte to produce Al—Sc alloys after electrolysis at high temperature. However, the scandium additions did not achieve levels higher than 0.5% Sc. Later work by one of the authors shows that this method had been improved to get close to greater than 2% Sc in the master alloy. See Tkacheva, O. Y. et al., "Influence Of Crystallization Conditions On The Structure And Modifying Ability Of Al—Sc Alloys", Russian Journal of Non-Ferrous Metals, Vol 58, No 1, pp 67-74 (2017).

Fujii et al., "Al—Sc Master Alloy Prepared By Mechanical Alloying Of Aluminium With Addition of $Sc_2O_3$", Materials Transactions, Vol 44, No 5, pp 2049-1052, attempted to produce a Al—Sc master alloy by mechanically alloying aluminium powder with scandium oxide powder. After the powders were milled together, the resulting product was extruded into a rod. Pieces of the rod were added to molten aluminium, and successful grain refining occurred. However, it is likely that melt cleanliness suffers with this approach.

Harata et al., "Production of Scandium and Al—Sc Alloy by Metallothermic Reduction", Sohn International Symposium on Advanced Processing of Metals and Materials: Principles, Technologies and Industrial Practice, San Diego, USA, 27-31, pp. 155-162 (August, 2006), examined the reduction of scandium oxide using a combination of calcium metal, aluminium metal and a calcium chloride flux. Metallothermic reduction with calcium of scandium fluoride is the common method for making scandium metal. Temperatures of 1000° C. and a sealed tantalum vessel were required in this approach.

WO 2014/138813A1 (Haidar), entitled "Production of Aluminium-Scandium Alloys", describes the use of very fine aluminium metal powder and a scandium chloride feed. However, no attempts at directly using scandium oxide are detailed.

SUMMARY OF THE DISCLOSURE

In one aspect, a method is provided for forming a scandium-bearing aluminum alloy. The method comprises preparing a mixture of scandium oxide and a first flux, thereby obtaining a flux-oxide mixture; mixing the flux-oxide mixture with a first portion of molten metal selected from the group consisting of aluminum and aluminum alloys, thereby obtaining a flux-metal mixture; obtaining a scandium-containing master alloy from the flux-metal mixture by performing the steps, in any order, of (a) cooling the flux-metal mixture, and (b) separating at least a portion of the flux from the flux-metal mixture; adding the scandium-bearing master alloy to a second portion of molten metal selected from the group consisting of aluminum and aluminum alloys, thereby obtaining a second metal mixture; and cooling the second metal mixture to obtain a scandium-bearing aluminum alloy; wherein the first flux contains less than 20% fluoride by weight, based on the total weight of flux added to the molten metal.

BRIEF DESCRIPTION OF THE DRAWINGS

FIG. 1 is a graph of Scandium content in an aluminum master alloy as a function of reaction time for a trial run of a method for producing a master alloy.

DETAILED DESCRIPTION

Scandium oxalate precipitation is known to be very selective over a number of possible impurity elements, and hence is widely used in scandium purification techniques. Moreover, the precipitated scandium oxalate pentahydrate may be readily calcined to produce scandium oxide. Partly for this reason, most scandium production methods are designed to produce scandium oxide as the main product, and scandium oxide is the most commonly traded form of scandium.

The production of scandium-containing aluminum alloys through the addition of scandium oxide to aluminum alloys is not a thermodynamically favourable process. However, the low activity of scandium in the molten alloy allows it to proceed via the reaction below:

$$Sc_2O_3+2Al \rightarrow 2Sc_{[Al]}+Al_2O_3$$

At present, scandium is often added to molten aluminum alloys as a 2% Sc—Al master alloy. The production of the master alloy requires high temperatures (approaching 900° C. for an extended period of time) in order to achieve a 2% Sc level. By contrast, most aluminum alloys are handled at temperatures lower than 800° C., and only have scandium additions of 0.1-0.3% Sc. The production of the master alloy itself requires approximately 4% by weight of scandium oxide (compared to the weight of aluminum in the alloy), which produces a similar amount of aluminum oxide as a by-product. Unfortunately, this excessive amount of by-product is detrimental to the physical quality of both the scandium-aluminum master alloy and the aluminum alloys that the master alloy is subsequently added to.

Various methodologies have been developed in the art to remove aluminum oxide from aluminum alloys. For example, some aluminum processing operations add a low melting point flux to the melt. In other processes, inert gases are injected into the melt for oxide removal. Still other processes use a combination of a flux and gas injection.

The fluxes utilized to remove aluminum oxide by-products from aluminum alloys are usually combinations of alkali metal halides (mostly chlorides). The prior art for adding scandium to aluminium using scandium oxide suggests that, in order to be successful, the halide fluxes need to be mixed and ground with scandium oxide, and then injected into the aluminum alloy with carbon dioxide or argon. Then prior art also suggests that vigorous agitation is required during the injection process. In theory, such fluxes operate by providing a material that is wet preferentially by the oxides over the metal, thus resulting in a physical separation of the flux and metal and enabling cleaning of the oxide from the alloy. Vigorous agitation, even in the presence of cleaning fluxes, can result in extra production of aluminium oxide containing dross.

Unfortunately, the 4% aluminium oxide generated by the Sc—Al master alloy represents a significantly greater mass of oxide than is normally dealt with in aluminum processing operations. Consequently, the choice of flux in this process is critical, and the amount of flux utilized is typically substantial (often about 10% by weight of the mass of the aluminium). Moreover, when a flux is utilized to introduce scandium oxide into aluminum alloys, some of the scandium oxide itself becomes entrapped within the flux. This entrapment interferes with the reaction of the scandium oxide with the aluminum alloy, and thus negatively affects the efficiency of the process and the amount of scandium incorporated into the resulting alloy. Hence, the current flux-based methods for incorporating scandium into a master alloy typically achieve lower levels of recovery of scandium to the master alloy than should theoretically be possible based on the amount of scandium oxide used.

Various attempts have been made in the art to address the foregoing problem. For example, in some known processes, scandium is added to aluminum alloys by converting scandium oxide to scandium fluoride, the latter of which reacts with molten aluminum more easily. Typically, the foregoing conversion is achieved by reacting scandium oxide with hot hydrogen fluoride gas at high temperatures. This reaction is both dangerous and technically challenging, since hydrogen fluoride gas is highly toxic and (especially at elevated temperatures) very reactive.

The production of scandium aluminum master alloys typically requires high temperatures (approaching 900° C.) for an extended period of time in order to achieve a 2% Sc level. If the flux composition is not carefully selected, these high alloying temperatures can result in high levels of oxidation of the aluminium.

It has been found in the aluminium industry that a simple mixture of equal molar parts of sodium chloride and potassium chloride melts at around the same temperature as the molten aluminium and may be utilized to provide a useful "cover flux". However, such a flux is not sufficient to enable scandium oxide entrained within the flux to react with the molten aluminium. Rather, it has been found that a small amount of alkali metal fluorides is also required to provide a pathway for scandium oxide entrained in the flux to react with the molten aluminium.

The prior art suggests that, in order to be successful, metallothermic reduction with calcium or magnesium is required. Other prior art suggests that the scandium oxide and aluminium need to be mechanically alloyed, or that electrolytic reduction needs to be utilized to assist in the reduction of the scandium oxide.

It is relatively easy to add scandium oxide to an alloy and get a measure of scandium oxide reduction. However, the aluminium oxide created in the process creates metal cleanliness issues for the molten aluminium. In addition, getting the scandium level up to 2% requires temperatures of up to 900° C. in order to keep the scandium in solution.

It has now been found that some or all of the foregoing problems may be overcome by pre-mixing a specially formulated flux with scandium oxide, prior to adding the scandium oxide to the melt. In a preferred embodiment, the flux mixture utilized contains less than 20% by weight of fluorides, with the rest being inexpensive chloride salts (such as, for example, sodium chloride or potassium chloride). Advantageously, the resulting flux is less hygroscopic, and is able to carry larger volumes of dissolved or dispersed aluminium oxide chemical reaction by-product.

Pre-grinding of the flux mixture with the oxide is not required in the preferred embodiment of the process described herein. Moreover, such an embodiment requires only minimal stirring. Hence, intermittent manual stirring, or the equivalent stirring that one would automatically achieve with induction furnace melting operations, is typically sufficient.

The processes disclosed herein typically utilize temperatures within the range of 750-1000° C., preferably in the range of 800-950° C., and more preferably in the range of 850-900° C. These processes also typically utilize reaction times of 30-180 minutes, preferably 60-150 minutes, and more preferably 90-120 minutes.

The manner in which the flux components are added to the molten alloy may be significant. In a preferred embodiment, the flux is added in two components initially. In particular, the fluorides are mixed with the scandium oxide and placed at the bottom of a crucible. The aluminium is then charged on top, and a sprinkling of the alkali metal chlorides is added as a cover flux on top. Without wishing to be bound by theory, this approach is believed to allow the scandium oxide and transfer reaction products to react with the molten aluminium before being diluted into the bulk flux mixture on the first stir.

In a typical reaction performed in a crucible, the dross which is produced forms an adherent "skull" on the crucible walls. This dross remains in a semi-molten state after the aluminium is poured off, allowing the dross to be simply scraped from the crucible walls.

It will be appreciated from the foregoing that preferred embodiments of the methodology disclosed herein also differ from some or all of the methods known to the prior art in that they require minimal agitation, and do not require gas injection, mechanical alloying, or electrolysis. Moreover, while pre-mixing of the flux salts and oxide is preferred, it is not necessary to pre-grinding these materials together. Significantly, preferred embodiments of the methodology disclosed herein allow up to 2% of scandium to be incorporated into the alloy without resorting to expensive reduction techniques.

Various fluoride-bearing salts may be utilized in the systems and methodologies disclosed herein. Preferably, these fluoride-bearing salts are used in combination with an NaCl—KCl cover flux mixture. Suitable fluoride-bearing salts may include calcium fluoride (fluorspar), aluminium fluoride, potassium fluoride, potassium aluminium fluoride (potassium cryolite), and various combinations or sub-combinations of the foregoing. It is found that more fluid mixtures are typically obtained when the fluoride components are KF—$AlF_3$ and KF-potassium cryolite. It has also been found that, when the flux is more fluid, the recovery of scandium to the master alloy tends to be higher.

The high temperature transfer reactions disclosed herein may also be utilized to incorporate other elements into the alloy. Thus, for example, rare earth oxides or fluorides (such as, for example, calcium fluoride, aluminum fluoride, potassium fluoride, and potassium aluminum fluoride) may be added to the flux mixture to incorporate rare earth elements into the alloy. Similarly, oxides or fluoride salts of boron, titanium, zirconium or hafnium may be added to the flux mix to incorporate those elements into the alloy. Of course, it will be appreciated that various combinations or sub-combinations of the foregoing materials may be added to the flux mixture to incorporate the corresponding elements into the alloy. Thus, for example, in some embodiments, flux-oxide mixtures may be utilized which contain at least two materials selected from the group consisting of (a) oxides of rare earth metals, (b) fluorides of rare earth metals, (c) oxides of hafnium, zirconium, titanium and boron, and (d) fluoride salts of hafnium, zirconium, titanium and boron. In other embodiments, The following specific, non-limiting example further illustrates the methodologies and compositions disclosed herein.

EXAMPLE 1

In this example, 5.5 grams of scandium oxide was pre-mixed with 1 gram of potassium fluoride and 1 gram of potassium cryolite. The mixture was added into a graphite crucible furnace. Charged on top was 126 grams of primary aluminium discs. On top of the aluminium, 6 grams of sodium chloride that had been pre-mixed with 6 grams of potassium chloride was sprinkled on top. The furnace was turned on with a setpoint of 880° C.

After 30 minutes, the furnace was up to temperature and the molten mixture in the furnace was stirred with a stainless-steel rod (that had been pre-coated with boron nitride suspension) for approximately 2 seconds. Every 30 minutes, the stirring was repeated. Just prior to stirring, a sample of the molten aluminium was taken by sucking the alloy into a borosilicate glass tube to freeze a "pin" sample. This sample was subjected to inductively coupled plasma optical emission spectrometry (ICP-OES) by a commercial laboratory. The results are shown in FIG. 1. As seen therein, a 2% Sc level in the master alloy was achieved inside 60 minutes.

At the end of the trial, the aluminium master alloy was simply poured into a steel mould. The residual dross was present as a semi-solid sludge adhering to the base of the crucible. A mass balance across the experiment showed that scandium recovery to the ingot was 74%.

It will be appreciated that scandium-bearing aluminum alloys (and especially master alloys) may be made with the systems and methodologies disclosed herein which have different percentages by weight of scandium in the alloy. Thus, for example, the percent by weight of scandium in the scandium-bearing alloy is typically at least 0.5%, preferably at least 1%, more preferably at least 1.5%, and most preferably at least 2%.

The flux-metal mixture may be maintained in a molten state for various amounts of time in embodiments of the systems and methodologies disclosed herein. Preferably, the flux-metal mixture is maintained in a molten state for at least 20 minutes, more preferably at least 40 minutes, and most preferably at least 60 minutes.

In preferred embodiments of the systems and methodologies disclose herein, a metal mixture is formed and is maintained in a molten state. This preferably includes maintaining the mixture at a temperature within the range of 750° C. to 1000° C., more preferably at a temperature within the range of 800° C. to 950° C., and most preferably at a temperature within the range of 850° C. to 900° C.

In some embodiments of the systems and methodologies disclosed herein, it is desirable to mixing the flux-oxide mixture with a first portion of molten metal. In some embodiments, this may include placing the first flux at the bottom of a container, placing a portion of the metal over the first flux, and melting the portion of metal to form the first portion of molten metal. In other embodiments, this may involve placing the first flux at the bottom of a container and pouring the first portion of molten metal over the first flux.

In some embodiments of the systems and methodologies disclosed herein, after the flux-oxide mixture is added to the first portion of molten metal, a second flux is added to the molten metal. Preferably, the second flux contains at least one alkali metal chloride, which is preferably selected from the group consisting of sodium chloride and potassium chloride. Preferably, the second flux contains a mixture of at least first and second alkali metal chlorides, and more preferably, the second flux contains a mixture of sodium chloride and potassium chloride.

In some embodiments of the systems and methodologies disclosed herein, the flux-oxide mixture may be fused prior to being mixed with a first portion of molten metal. In such embodiments, the fused flux-oxide mixture may be mixed with the first portion of molten metal as a liquid. The resulting flux-metal mixture may be mixed using any suitable mixing device or technique including, for example, the use of a mechanical agitation device or induction heating.

Some embodiments of the systems and methodologies disclosed herein make advantageous use of a master alloy. In such embodiments, the master alloy may be produced without mechanical alloying, and/or without electrolysis. Moreover, in such embodiments, a scandium-containing master alloy may be obtained from the flux-metal mixture by a process which includes cooling the flux-metal mixture, and separating at least a portion of the flux from the cooled flux-metal mixture, or separating at least a portion of the flux from the flux-metal mixture, and then cooling the flux-metal mixture.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims. In these claims, absent an explicit teaching otherwise, any limitation in any dependent claim may be combined with any limitation in any other dependent claim without departing from the scope of the invention, even if such a combination is not explicitly set forth in any of the following claims.

What is claimed is:

1. A method for forming a scandium-bearing aluminum alloy, comprising:

preparing a mixture of scandium oxide and a first flux, thereby obtaining a flux-oxide mixture;

mixing the flux-oxide mixture with a first portion of molten metal selected from the group consisting of aluminum and aluminum alloys, thereby obtaining a flux-metal mixture;

obtaining a scandium-containing master alloy from the flux-metal mixture by performing the steps, in any order, of (a) cooling the flux-metal mixture, and (b) separating at least a portion of the flux from the flux-metal mixture;

adding the scandium-bearing master alloy to a second portion of molten metal selected from the group consisting of aluminum and aluminum alloys, thereby obtaining a second metal mixture; and cooling the second metal mixture to obtain a scandium-bearing aluminum alloy;

wherein the first flux contains less than 20% fluoride by weight, based on the total weight of flux added to the molten metal.

2. The method of claim 1, wherein the percent by weight of scandium in the scandium-bearing master alloy is at least 0.5%.

3. The method of claim 1, further comprising:

maintaining the flux-metal mixture in a molten state for at least 40 minutes.

4. The method of claim 1, wherein maintaining the metal mixture in a molten state includes maintaining the mixture at a temperature within the range of 800° C. to 950° C.

5. The method of claim 1, wherein maintaining the metal mixture in a molten state includes maintaining the mixture at a temperature within the range of 850° C. to 900° C.

6. The method of claim 1, wherein mixing the flux-oxide mixture with the first portion of molten metal comprises:

placing the first flux at the bottom of a container;

placing a portion of the metal over the first flux; and melting the portion of metal to form the first portion of molten metal.

7. The method of claim 1, wherein mixing the flux-oxide mixture with the first portion of molten metal comprises:

placing the first flux at the bottom of a container; and pouring the first portion of molten metal over the first flux.

8. The method of claim 1, further comprising:

after the flux-oxide mixture is added to the first portion of molten metal, adding a second flux to the molten metal, wherein the second flux contains at least one alkali metal chloride.

9. The method of claim 8, wherein the at least one alkali metal chloride is selected from the group consisting of sodium chloride and potassium chloride.

10. The method of claim 1, wherein said flux-oxide mixture contains at least one rare earth metal oxide, and wherein said master alloy contains the corresponding rare earth metal.

11. The method of claim 1, wherein said flux-oxide mixture contains at least two materials selected from the group consisting of (a) oxides of rare earth metals, (b) fluorides of rare earth metals, (c) oxides of hafnium, zirconium, titanium and boron, and (d) fluoride salts of hafnium, zirconium, titanium and boron.

12. The method of claim 1, wherein preparing the flux-oxide mixture does not include grinding the flux-oxide mixture.

13. The method of claim 1, wherein mixing the flux-oxide mixture with the first portion of molten metal occurs without gas injection.

14. The method of claim 1, wherein the flux-oxide mixture is fused prior to being mixed with the first portion of molten metal.

15. The method of claim 14, wherein the fused flux-oxide mixture is mixed with the first portion of molten metal as a liquid.

16. The method of claim 1, further comprising stirring the flux-metal mixture with induction heating.

17. The method of claim 1, further comprising stirring the flux-metal mixture with a mechanical agitation device.

18. The method of claim 1, wherein the master alloy is produced without mechanical alloying.

19. The method of claim 1, wherein the master alloy is produced without electrolysis.

20. The method of claim 1, wherein the first flux comprises a material selected from the group consisting of calcium fluoride, aluminum fluoride, potassium fluoride, and potassium aluminum fluoride.

21. The method of claim 1, wherein obtaining a scandium-containing master alloy from the flux-metal mixture includes cooling the flux-metal mixture, and separating at least a portion of the flux from the cooled flux-metal mixture.

22. The method of claim 1, wherein obtaining a scandium-containing master alloy from the flux-metal mixture includes separating at least a portion of the flux from the flux-metal mixture, and then cooling the flux-metal mixture.

23. The method of claim 1, wherein said flux-oxide mixture contains a pairing selected from the group consisting of (a) at least one rare metal oxide, and wherein said master alloy contains the corresponding rare earth metal; (b) at least one material selected from the group consisting of oxides of boron and fluoride salts of boron, and wherein said master alloy contains boron; (c) at least one material selected from the group consisting of oxides of titanium and fluoride salts of titanium, and wherein said master alloy contains titanium; wherein said flux-oxide mixture contains at least one material selected from the group consisting of oxides of zirconium and fluoride salts of zirconium, and wherein said master alloy contains zirconium; at least one material selected from the group consisting of oxides of hafnium and fluoride salts of hafnium, and wherein said master alloy contains hafnium; at least one material selected from the group consisting of oxides of niobium and fluoride salts of niobium, and wherein the master alloy contains niobium.

24. The method of claim 1, wherein said flux-oxide mixture contains a pairing selected from the group consisting of (a) at least one fluoroborate, and wherein said master alloy contains boron; (b) at least one fluorotitanate, and wherein said master alloy contains titanium; (c) at least one fluorozirconate, and wherein said master alloy contains zirconium; (d) at least one fluorohafnate, and wherein said master alloy contains hafnium; and (e) at least one fluoroniobate, and wherein said master alloy contains niobium.

* * * * *